United States Patent [19]

Miller

[11] 4,376,366

[45] Mar. 15, 1983

[54] SAFETY HALTER FOR HORSES

[76] Inventor: Nathan W. Miller, 15111 Pipeline Ave., Chino, Calif.

[21] Appl. No.: 610,638

[22] Filed: Sep. 5, 1975

[51] Int. Cl.[2] ..... B68B 1/02

[52] U.S. Cl. ..... 54/24; 119/106

[58] Field of Search ..... 54/24, 26–28, 54/85, 87, 6 R, 6 A; 119/96, 110, 114, 106

[56] References Cited

U.S. PATENT DOCUMENTS

| | | | |
|---|---|---|---|
| 3,011,478 | 12/1961 | Kirby | 119/110 X |
| 3,131,674 | 5/1964 | Dalton | 119/110 X |
| 3,605,384 | 9/1971 | Pacini | 54/24 |

*Primary Examiner*—Louis G. Mancene
*Assistant Examiner*—Peter K. Skiff
*Attorney, Agent, or Firm*—Gene W. Arant

[57] ABSTRACT

A halter for horses wherein the halter includes a headstall composed of a strap encircling the forward portion of the neck at the head, the strap being provided with a conventional buckle or other separable securing device, and the encircling strap of the headstall also having, operatively coupled in parallel with the conventional buckle, a separable fastener which is disengageable under the influence of a predetermined amount of force tending to separate the encircling strap portions.

9 Claims, 5 Drawing Figures

SAFETY HALTER FOR HORSES

The invention relates to an improved halter primarily for use on horses.

Many horse owners put halters on horses when they are at pasture or in corrals so that when they are caught for riding or other purposes it is a simple matter to attach a lead rope to the halter and to lead the horse to the place where it is to be saddled or put to some other use.

Past experience has shown that horses with bridles sometimes catch portions of the bridles on fence posts or other anchored structures and in an attempt to pull free often injure themselves. Furthermore, even though the horse may not be injured, the struggles of the animal to free himself frequently cause damage to or destruction of the halter.

It is a general object of the invention to provide a halter construction which, when the animal becomes entangled by the halter with some anchored object, the struggle of the horse to free himself will create sufficient force to permit parts of the halter to separate so that the horse can free himself of the halter and neither the animal nor the harness will be injured.

The above and other objects will more fully appear from the following description in connection with the accompanying drawing.

Figure 1:
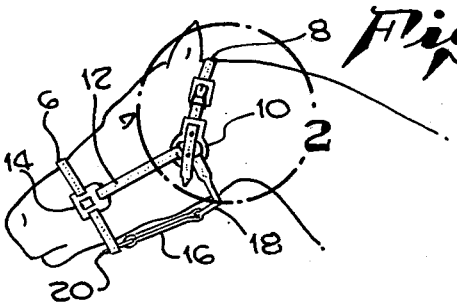
FIG. 1 is a side elevational view of an embodiment of the invention with the head and neck portions of a horse shown therewith.

There is illustrated a halter which includes a nose band 6 and a headstall 8, the latter being in the form of a strap-like portion which encircles the forward or upper part of the neck of the horse just behind the head, a ring 10 being located in the encircling strap of the headstall 8 at both sides (only one being shown). This ring is provided for the connection of a cheek piece 12 in the form of a strap at each side leading from the ring 10 to a "square" 14 connected in the nose band strap 6 in the customary manner. There is also a throat strap 16 which is connected from the lower section 18 of the headstall 8 to a ring 20 in the lower portion of the nose band strap 6.

The headstall 8, in its upper portion, includes a strap section 22 having a series of holes 24 which are adapted to selectively receive a tongue 26 pivotally mounted on a cross-bar 28 extending between the vertical spaced sides 30 of a conventional buckle generally indicated at 32. The buckle 32 is shown fastened to the headstall strap section 22 with the buckle tongue 26 in the secured position in broken lines and in its released position in full lines in FIG. 3.

Secured about the cross pin 28 on buckle 32 and extending upwardly from the buckle is a folded strap section 34 whose upper portion is folded over the lower horizontal or base portion 36 of a spring metal separable fastener element 40. This fastener element or spring clip 40 has a pair of spaced legs 42 which terminate at their upper portions in outwardly and oppositely disposed leg ends 44 adapted to be received in sockets 46 formed in the inner surfaces of spaced side pieces 48 which may if desired constitute portions of a conventional buckle.

Thus it will be seen that the headstall, including its two rings 10 located on respective sides of the horse's head and also including the lower or throat latch portion 18 thereof in addition to the crown member 8, 34, completely encircles the neck of the horse. On one side of the horse's head, seen in FIGS. 1 and 4, the headstall 8 includes overlapping strap portions 34 and 22. The lower end of strap portion 34 is permanently attached to a buckle 32 formed as part of ring 10. A separable fastener element 40 is permanently secured to the upper end of strap portion 34. The upper end of strap portion 22 is permanently attached to that portion of the headstall 8 which passes over the top of the horse's neck. The upper end of strap portion 22 also has a buckle 46, 48 permanently attached thereto. Holes 24 are formed in the lower end of strap portion 22. Movable tongue 26 secured to buckle 32 may be selectively attached to strap 22 by means of one of the holes 24, and separable fastener element 40 secured to the upper end of strap portion 34 may be selectively attached to the buckle 46–48 carried by strap 22. It therefore follows that both of these attachments may be made, or only one of them, or neither of them.

Figure 4:
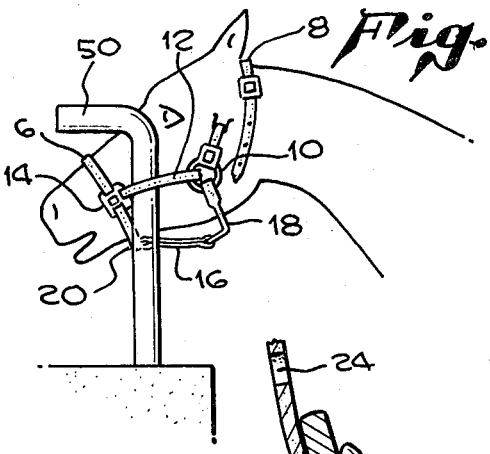
FIG. 4 is a view similar to FIG. 1 but with the halter shown caught over a post and parts of it separated due to the tension applied by the horse.
Figure 2:
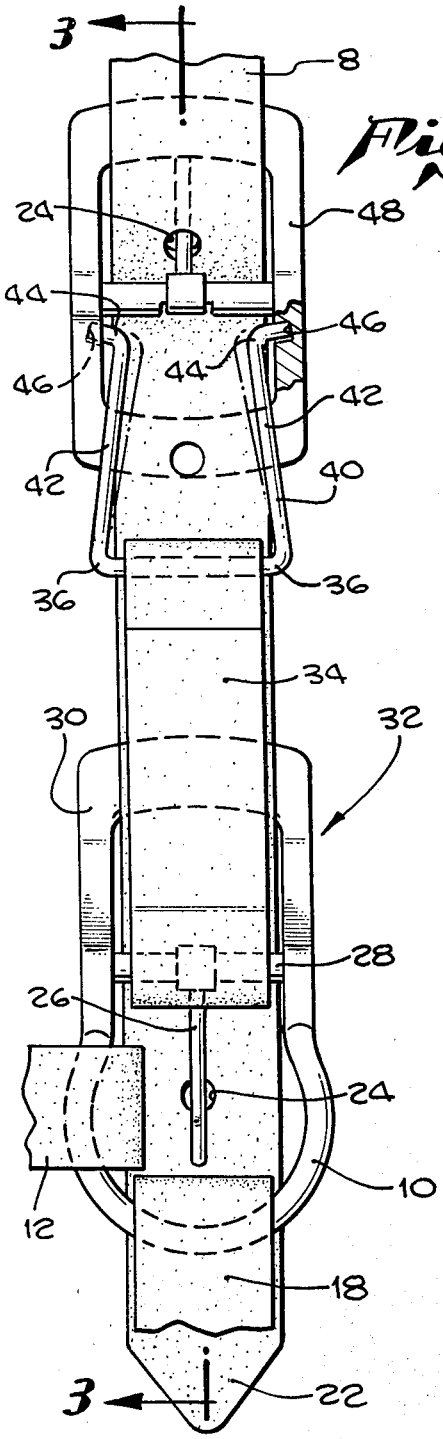
FIG. 2 is an enlarged detail, with portions broken away and portions shown in alternate positions in full and broken lines, this view being taken approximately on the circle 2 of FIG. 1.

It is important to note that the sockets 46 and the leg ends 44 of the spring metal clip or fastener element 40 are angled somewhat downwardly and inwardly relative to the clip base 36. The walls of the sockets 46 comprise camming surfaces and the outwardly bent leg ends 44 of the spring fastener element 40 comprise cam followers. The angularity of the walls of sockets 46 and the bent leg ends 44 is such that a considerable amount of pull or tension can be applied to the headstall 8 of the halter without causing separation of the spring fastener 40 from the sockets 46. In other words, the headstall strap will not become unfastened due to the rubbing of the horse against another animal or against a tree or fence post or the like, but will become unfastened, however, should the animal get the halter entangled with some stationary object such as the post 50 which may be a stanchion post in a stall or on a feed trough in a barn or in the field. Of course, any other object upon which the halter might be caught would result in the animal attempting to pull away. In so doing it would place the headstall 8 under tension or torsion and a sufficient amount of either or both will result in displacement of the bent leg ends 44 of the spring fastener element 40 from the sockets 46 as illustrated in FIG. 4 and as shown more in detail in broken lines in FIG. 2.

Figure 3:
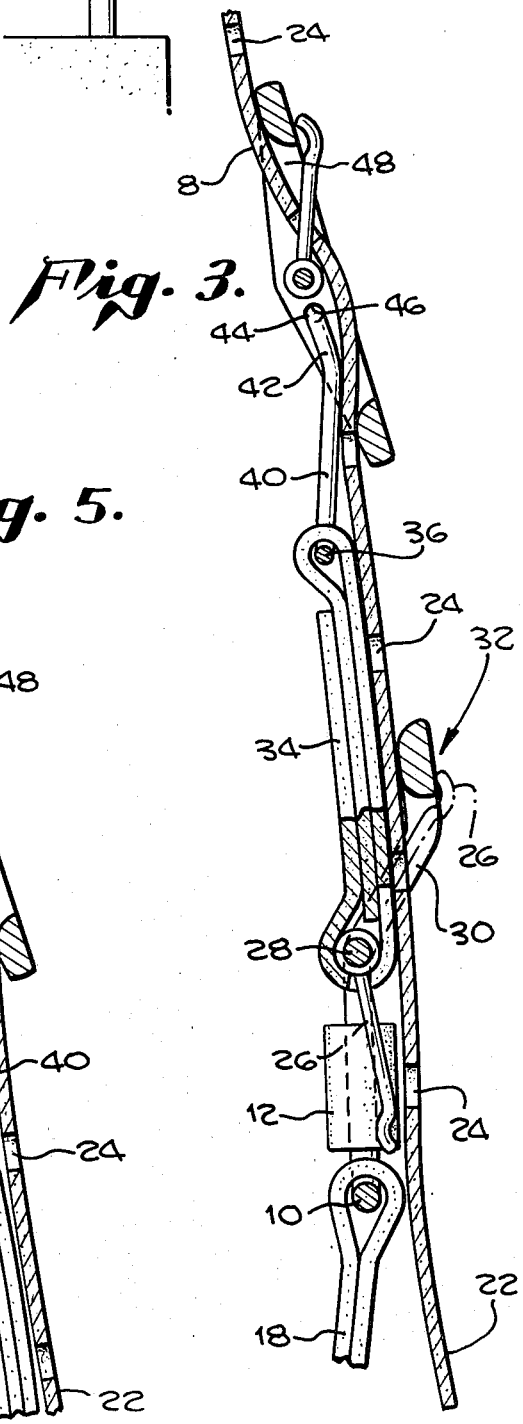
FIG. 3 is a longitudinal sectional view taken approximately on the line 3—3 of FIG. 2.
Figure 5:
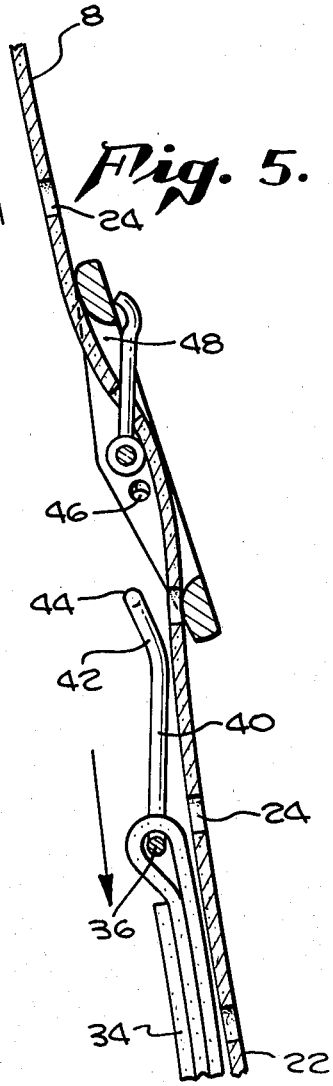
FIG. 5 is a sectional view of a portion of the structure shown in FIG. 3 with the halter strap connections shown in a different adjusted position.

The separation of the headstall strap portions which encircle the neck of the horse will occur of course only when the conventional or secure buckle 32 is in its unfastened position with the tongue 26 of that buckle in the position shown in full lines in FIG. 3. This is a condition of the halter when the animal is let out to pasture or is let loose in a corral. On the other hand, when the halter is being used to lead the horse or if reins are attached to it and it is used to control the horse when riding then the buckle 32 is secured to the strap 22 with the buckle tongue 26 in the broken line position of FIG. 3. When in this position any strain imposed on the headstall 8 is carried by the fastened buckle 32 which connects straps 18 and 22, and the separable fastener element 40 with its retainer sockets 46 is not subjected to any strain whatsoever. In other words, the secure buckle 32 and the breakaway buckle 36–48 are operatively coupled in parallel, with the fastening load normally being carried entirely by the secure buckle. In order to make the safety feature of the halter operative it is necessary only to remove the buckle tongue 26 from one of the apertures 24 in the strap 22 which it then occupies.

While I have shown the spring fastener element 40 as being retained in the sockets 46 in the sides 48 of a conventional buckle, it should be understood that the sockets 46 can be formed in any type of separable receiver for the spring connector element 40. The receiver need not be part of a conventional buckle.

From the foregoing it will be seen that I have provided a safety halter for horses wherein the halter can be used in the ordinary manner for leading or guiding a horse and the halter can be then kept in such condition that the person who leads or rides the horse can remain in complete control insofar as the strength of the halter is concerned. When the animal is placed to pasture the halter can be left on it and should the horse get the halter entangled in some object the automatic safety release will come into play and neither the animal nor the harness will be injured.

It should, of course, be understood that various changes can be made in the form, detail, arrangement, and proportions of the various parts without departing from the spirit of the invention.

I claim:

1. In a horse halter, a headstall having first and second overlapping strap end portions, and a breakaway fastener releasably coupling said strap portions together, said breakaway fastener comprising:

a buckle attached to said first strap portion;

a generally U-shaped spring clip having its base part secured within said second strap portion and its legs extending therebeyond, the outer ends of said legs being outwardly turned and also being inclined at a small angle away from the base part of said spring clip;

said buckle having oppositely facing sockets which receive said clip leg ends;

whereby a longitudinal pull of sufficient magnitude upon said second strap portion relative to said first strap portion causes said spring clip legs to bend towards each other, releasing said leg ends from said sockets and said two strap portions from each other.

2. The halter of claim 1 wherein the walls of said sockets are also inclined at a small angle relative to said spring clip base.

3. A halter for horses having a nose strap, a headstall, and strap means coupling said headstall to said nose strap, said headstall comprising:

an encircling strap adapted to extend about the neck of a horse and having overlapping strap end portions;

a positive fastener releasably coupling said overlapping strap end portions together; and a yieldably separable fastener also releasably coupling said overlapping strap end portions together;

said fasteners being so arranged that said positive fastener normally carries the fastening load;

whereby when the horse is let out to pasture said positive fastener may be unfastened so that the halter is held in place only by said yieldably separable fastener;

said yieldably separable fastener including two relatively separable parts which are adapted to separate from each other whenever the halter becomes caught in an anchored structure and the horse attempts to break away.

4. A breakaway horse halter having a headstall adapted to encircle the neck of a horse, said headstall including:

an encircling strap adapted to extend about the neck of a horse and having overlapping strap end portions;

a secure fastener normally coupling said overlapping strap end portions together; and a breakaway fastener releasably coupling said overlapping strap end portions together;

said fasteners being so arranged that the secure fastener normally carries the fastening load, and said breakaway fastener including two relatively separable parts which are adapted to separate from each other whenever stress is applied thereto;

whereby when the horse is let out to pasture said secure fastener may be unfastened and the headstall will then be held in place by said breakaway fastener, so that if the halter becomes caught in an anchored structure and the horse attempts to break away therefrom, said breakaway fastener will operate to release the halter from the neck of the horse before the horse injures itself.

5. An animal halter comprising, (a) a crown member for positioning behind the ears and across said animal, (b) band means for surrounding the nose of said animal, (c) cheek strap means for attaching said band means to said crown member on opposite sides of said halter, (d) means extending from one side of said halter to the other and positioned to pass beneath the head of said animal rearwardly of said band means, and (e) means for releasably holding said crown member intact on said animal, said releasably holding means being operative to disunite said crown piece upon the imposition of a force on said halter which is less than that otherwise needed to break the halter, and (f) means for inactivating said releasable means.

6. A halter as in claim 5 wherein said inactivating means is manually operable.

7. A halter as claimed in claim 5 wherein said inactivating means includes a secure fastener operatively coupled in parallel with said releasable holding means, whereby when said secure fastener is fastened, the imposition of a force on said halter will not disunite said crown means.

8. A halter as claimed in claim 5 wherein said releasable holding means includes a buckle member having fixed side pieces, and a spring clip member having a generally U-shaped configuration with a parallel pair of spaced legs whose ends are bent outwardly, said spring clip legs being received between said side pieces of said buckle member and normally held therein by said bent leg ends.

9. An animal halter adapted to protect the animal from injury when the halter becomes caught in an anchored structure, comprising:

nose strap means for surrounding the nose of the animal;

headstall means for extending behind the ears and across the back of the neck of the animal;

cheek strap means coupling said headstall means to said nose band means and including separate straps adapted to extend along opposite cheeks of the animal;

throat strap means extending transversely between said separate straps of said cheek strap means and adapted to pass beneath the throat of the animal;

first fastening means incorporated into said headstall means and being operable, upon the imposition of a force upon said halter which is less than that otherwise needed to break the halter, to disunite said headstall means into two separate parts so that the animal may break away from the anchored structure; and second fastening means operatively coupled in parallel with said first fastening means and manually operable for securely fastening said two parts of said headstall together, thereby precluding the action of said first fastening means.

* * * * *